US009216747B2

(12) United States Patent
Matoba et al.

(10) Patent No.: US 9,216,747 B2
(45) Date of Patent: Dec. 22, 2015

(54) LID BODY LOCKING APPARATUS OF RAILCAR

(71) Applicant: KAWASAKI JUKOGYO KABUSHIKI KAISHA, Kobe-shi, Hyogo (JP)

(72) Inventors: Takahiro Matoba, Kobe (JP); Hiroki Tanaka, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 14/360,769

(22) PCT Filed: Jan. 31, 2013

(86) PCT No.: PCT/JP2013/000514

§ 371 (c)(1),
(2) Date: May 27, 2014

(87) PCT Pub. No.: WO2013/114879

PCT Pub. Date: Aug. 8, 2013

(65) Prior Publication Data

US 2015/0175174 A1 Jun. 25, 2015

(30) Foreign Application Priority Data

Jan. 31, 2012 (JP) ..... 2012-017788

(51) Int. Cl.
*E05C 5/02* (2006.01)
*B61D 19/00* (2006.01)
(Continued)

(52) U.S. Cl.
CPC ..... *B61D 19/00* (2013.01); *B61D 17/00* (2013.01); *E05B 35/008* (2013.01); *E05B 41/00* (2013.01);
(Continued)

(58) Field of Classification Search
CPC ..... E05C 3/12; E05C 3/14; E05C 3/145; E05C 3/16; E05C 3/165; E05C 3/167; E05B 63/0003; E05B 63/0047; E05B 83/02
USPC ..... 70/404, 139, 387, 388, 473–480, 70/483–485, 432, DIG. 59; 292/95, 96, 292/101, 108, 57, 58, 63, 64, 66, 67, 194, 292/195, 202, 210, 244, 245, 200, 100, 256, 292/256.5, 257, DIG. 11, DIG. 27
See application file for complete search history.

(56) References Cited

U.S. PATENT DOCUMENTS 1,997,528 A * 4/1935 Lovatt ..... 70/139
2,012,885 A * 8/1935 Lovatt ..... 49/368
(Continued)

FOREIGN PATENT DOCUMENTS

JP Y-37-015094 6/1962
JP A-58-117817 7/1983
(Continued)

OTHER PUBLICATIONS

Aug. 5, 2014 International Preliminary Report on Patentability (IPRP) of PCT/JP2013/000514 filed Jan. 31, 2013.

*Primary Examiner* — Alyson M Merlino
(74) *Attorney, Agent, or Firm* — Oliff PLC

(57) ABSTRACT

A locking apparatus includes a shaft member having an operating shaft of a non-circular shape in cross section, and a body member including a bearing part and a cylindrical part. A cover member of a ring shape is fixed to the inner circumferential surface of the cylindrical part, at a position corresponding to a tip end of the operating shaft, and a movable member is slidably fitted onto the operating shaft. The movable member is configured so that it is located at a normal position where the movable member fills a clearance between the operating shaft and the cover member when a latch member engages with the car body, and the movable member is maintained at a retreated position that is retreated from the normal position when the movable member is plunged, the operating shaft is rotated, and the engagement between the latch member and the car body is released.

16 Claims, 9 Drawing Sheets

(51) Int. Cl.

| | |
|---|---|
| ***E05B 63/00*** | (2006.01) |
| ***E05C 3/14*** | (2006.01) |
| ***B61D 17/00*** | (2006.01) |
| ***E05B 41/00*** | (2006.01) |
| ***E05B 35/00*** | (2006.01) |
| ***E05B 83/02*** | (2014.01) |
| ***E05C 3/04*** | (2006.01) |
| ***E05B 65/08*** | (2006.01) |
| *E05C 3/06* | (2006.01) |

(52) U.S. Cl.
CPC ..... *E05B 63/003* (2013.01); *E05B 63/0047* (2013.01); *E05B 65/0811* (2013.01); *E05B 83/02* (2013.01); *E05C 3/042* (2013.01); *E05C 3/145* (2013.01)

(56) References Cited

U.S. PATENT DOCUMENTS

| | | | | |
|---|---|---|---|---|
| 3,661,001 | A * | 5/1972 | Glass | 70/388 |
| 4,289,001 | A * | 9/1981 | Corfield | 70/346 |
| 4,794,772 | A * | 1/1989 | Falk et al. | 70/491 |
| 4,838,060 | A * | 6/1989 | Hutzenlaub | 70/491 |
| 7,320,236 | B2 * | 1/2008 | Monneret et al. | 70/169 |

FOREIGN PATENT DOCUMENTS

| | | |
|---|---|---|
| JP | A-60-024915 | 2/1985 |
| JP | U-60-081162 | 6/1985 |
| JP | A-64-014482 | 1/1989 |
| JP | A-09-310705 | 12/1997 |

* cited by examiner

LID BODY LOCKING APPARATUS OF RAILCAR

TECHNICAL FIELD

The present invention relates to a lid body (for example, a side closing plate) locking apparatus of a railcar.

BACKGROUND ART

In railcars, for example, an accommodation recess which accommodates instruments necessary to be periodically checked is formed in a car body, and a lid body (a closing plate) which covers an opening of the accommodation recess is locked so that a third party cannot open carelessly has been known (for example, refer to Patent Documents 1 to 3).

A locking apparatus for latching such a lid body to the car body is desired to be configured so that its locked state is easily visible only at a glance. In addition, since frequency of opening and closing is often, it is desired to be configured so that unlocking is easy when, for example, a maintenance operator performs the unlocking, but person other than the operator cannot unlock freely.

CITATION LIST

Patent Document

[Patent Document 1] JP37-015094Y (Page 1)
[Patent Document 2] JP60-081162U (Page 8)
[Patent Document 3] JP09-310705A (Paragraph 0013)

SUMMARY OF THE INVENTION

Technical Problem

In the structure of Patent Document 1, since a push rod projects into a square hole in both a locked state and an unlocked state, it cannot be determined whether it is in the locked state or the unlocked state only by visually checking the push rod.

In the structure of Patent Document 2, it can be unlocked using a wrench or the like, and, in the structure of Patent Document 3, it is unlocked using a hexagonal wrench. Therefore, unlocking is possible by any person other than the operator allowed in advance.

The present invention provides a lid body locking apparatus of a railcar, which allows an operator of maintenance or the like to easily unlock but does not allow any person other than the operator to unlock, in addition to securing perceptibility of a locked state.

Solution to the Problem

A lid body locking apparatus of the present invention is characterized in that it is a lid body locking apparatus of a railcar, for locking a lid body, that opens and closes an opening formed in a car body of the railcar, to the car body in a state where the lid body closes the opening. The apparatus includes a shaft member having one end portion formed with an operating shaft of a non-circular shape in cross section and the other end portion fixed to a latch member that engages with the car body, a body member penetrating the lid body, and including a bearing part for rotatably supporting an intermediate part of the shaft member and a cylindrical part for accommodating the operating shaft, a cover member of a ring shape, fixed to an inner circumferential surface of the cylindrical part at a position corresponding to the tip end of the operating shaft, and defining a clearance around the operating shaft, and a movable member slidably fitted onto the operating shaft. The movable member is configured to be located at a normal position where it fills the clearance between the operating shaft and the cover member when the latch member engages with the car body. The movable member is configured to be maintained at a retreated position that is retreated from the normal position when the engagement between the latch member and the car body is released by pushing into the movable member and rotating the operating shaft.

According to the configuration described above, since unlocking and locking of the lid body to the car body can be performed by rotating the movable member together with the shaft member in the state where the movable member is plunged, opening and closing operations are easy. Further, since the movable member is located at the normal position in a locked state and the movable member is maintained at the retreated position that is retreated from the normal position in an unlocked state, the locked state and the unlocked state can easily be checked visually. In addition, since the movable member fills the clearance between the operating shaft and the cover member at the normal position, air resistance of the railcar at the time of traveling can be suppressed. Snow accretion can also be prevented by such a configuration. Further, since the operating shaft is surrounded by the movable member at the normal position when the movable member fills the clearance between the operating shaft and the cover member, it cannot be unlocked easily by any person other than an operator.

For example, the movable member may include a base plate part that is able to contact the back side of the cover member, and a projected portion projecting from the base plate part to fill the clearance between the operating shaft and the cover member. The apparatus may further include a spring member for biasing the movable member toward the cover member.

One or more engagement grooves extending in an axial direction of the shaft member may be formed in the inner circumferential surface of the cover member. The projected portion of the movable member may include a central base portion of a tubular shape, and at least one engaging pawl portion that radially projects from the central base portion and engages with the engagement groove when the movable member is located at the normal position. According to this configuration, by the position of the engaging pawl portion, it can be known to which direction the operating shaft should be rotated for unlocking or locking. In addition, when the movable member is at the normal position, the engaging pawl portion engages with the engagement groove. Therefore, since the operating shaft cannot be rotated unless the movable member is in a state where the movable member is plunged, the lid body will not be unlocked unnecessarily.

The spring member may be a coil spring arranged to surround the operating shaft. According to this configuration, since the diameter of the coil spring can be increased, the locked state can be maintained with a large spring force, and it can avoid a third party from carelessly unlocking it.

The latch member may include a mounting part mounted to the other end portion of the shaft member, and a latch portion of a rectangular plate shape formed continuously to the mounting part, and the latch member latches by locating the latch portion inside a latch receiving portion of the car body by the rotation of the shaft member. According to this configuration, it can be applied to both the cases where a clockwise rotation causes locking and a counterclockwise rotation causes unlocking, and where the clockwise direction causes unlocking and the counterclockwise rotation causes unlocking. Therefore, the latch member can be used commonly in both the cases where the clockwise rotation causes locking and the counterclockwise rotation causes unlocking, and where the clockwise direction causes unlocking and the counterclockwise rotation causes unlocking.

The external surface of the lid body, and the surfaces of the body member and the cover member may form a single surface. According to this configuration, by forming the external surface of the lid body, the surfaces of the body member, and the cover member in the single surface, it can also be a snow accretion preventive measure. In addition, with such a configuration, noise such as wind noise can be suppressed and, thus, it is suitable especially for high speed railway vehicles.

The operating shaft may be rotated by a tool. The tool may include a hollow pushing part having a recessed portion that is engageable and disengageable with/from the operating shaft and for pushing into the movable member, and a pushing pawl portion provided to the hollow pushing part and corresponding to the engaging pawl portion. The engagement groove may include two engagement grooves. The cover member may be configured so that the tool is plunged to engage the operating shaft with the recessed portion while inserting the pushing pawl portion into one of the engagement grooves, the entire tool is rotated to releases the engagement between the latch member and the car body, and the pushing pawl portion can then be pulled out from the other engagement groove. According to this configuration, locking and unlocking can easily be performed using the tool, and it can be constructed so that the tool will not be pulled out at any intermediate rotational position.

Advantageous Effects of the Invention

Since, in the present invention, engagement and disengagement of the lid body to the car body can be performed by pushing into the movable member and rotating the operating shaft, as described above, opening and closing operations are easy. In addition, since the movable member is maintained at the normal position in the locked state and at the retreated position which is retreated from the normal position in the unlocked state, the locked state can be easily and visibly checked.

DESCRIPTION OF EMBODIMENTS

Hereinafter, embodiments of the invention are described with reference to the drawings.

Figure 1:
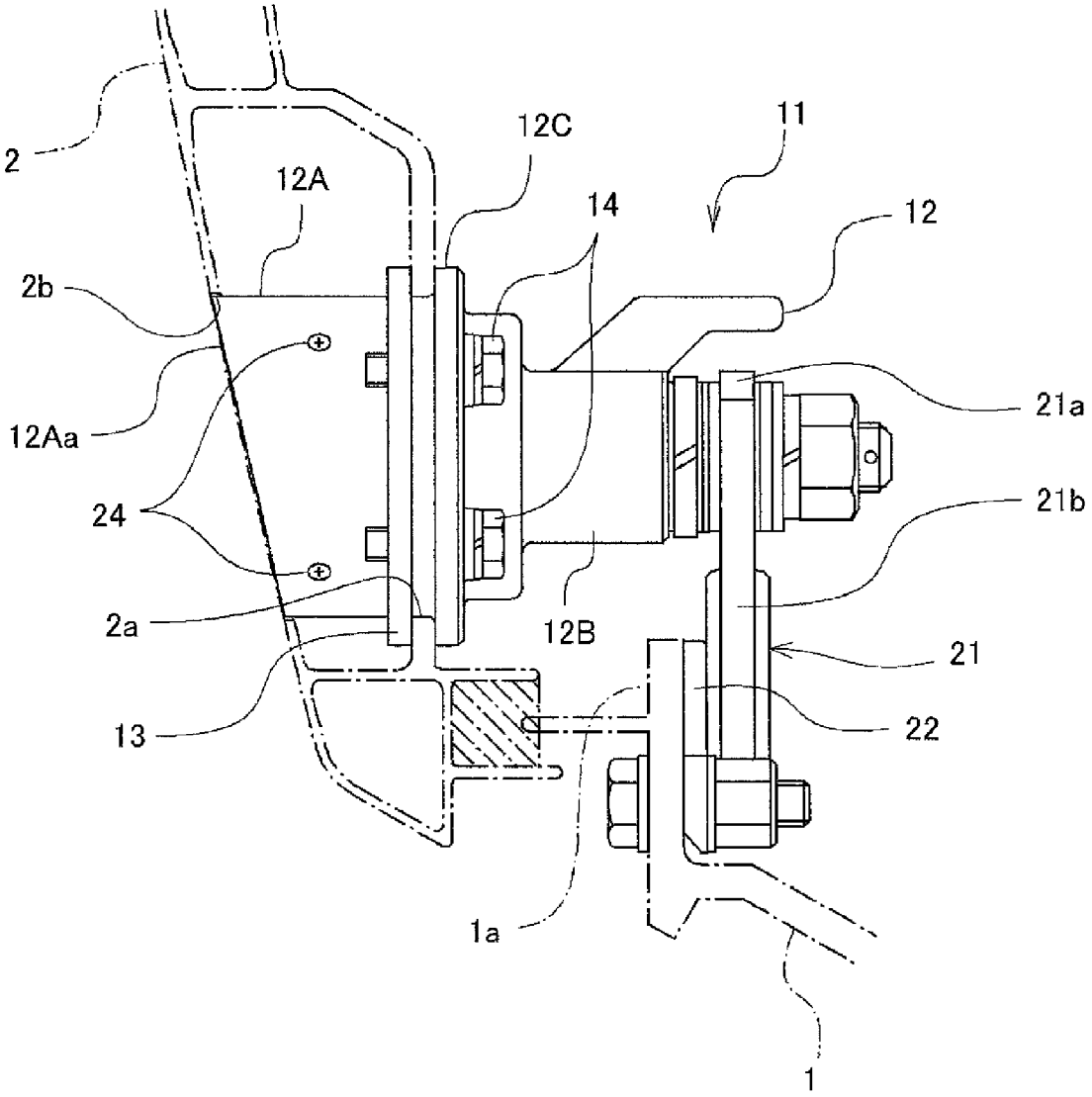
FIG. 1 is a view showing a lid body locking apparatus of a railcar according to one embodiment of the present invention.

FIG. 1 is a view showing a lid body locking apparatus 11 of a railcar according to one embodiment of the invention.

The lid body locking apparatus 11 of this embodiment latches a lid body 2, which opens and closes an opening (not shown) formed in a side body structure 1 which is a part of a car body, to the side body structure 1 in a state where the opening is closed. An upper edge of the lid body 2 is pivotally mounted to an upper edge of the opening via hinge(s) (not shown), and a lower edge of the lid body 2 is releasably latched to the side body structure 1 by the locking apparatus 11.

However, the opening which is opened and closed by the lid body 2 is not necessary to be formed in the side body structure 1, but may be provided in any part of the car body. Hereinafter, for convenience of explanation, outward in the vehicle width directions is referred to as "forward," and inward is referred to as "rearward."

Figure 3:
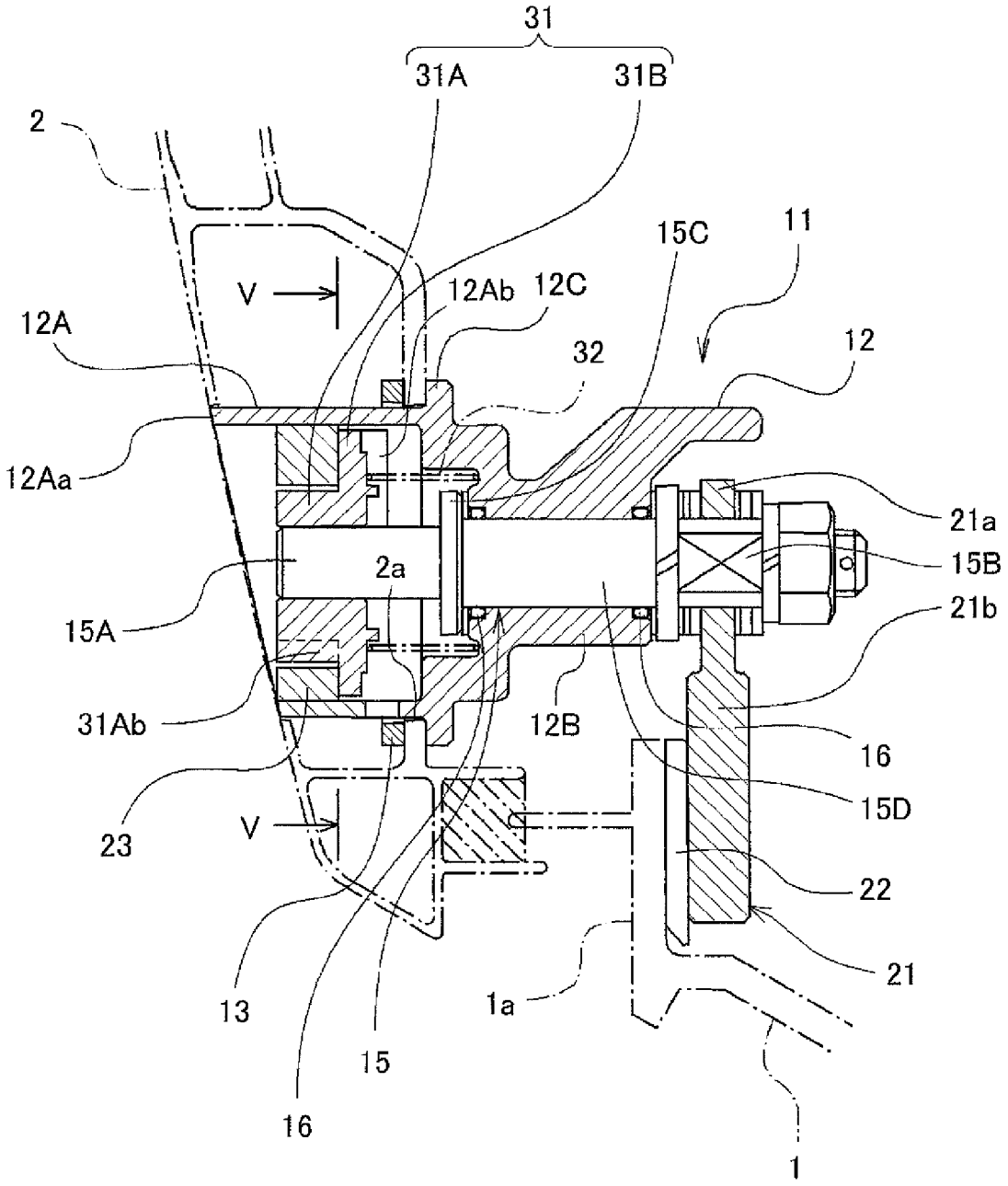
FIG. 3 is a line cross-sectional view of FIG. 2.

The locking apparatus 11 includes a body member 12 which penetrates the lid body 2, and a shaft member 15 (refer to FIG. 3) held by the body member 12. The shaft member 15 extends in a front-to-rear direction or a rear-to-front direction (vehicle width directions), an operating shaft 15A of a non-circular shape in cross section is formed in a front end portion (one end portion) thereof, and a latch member 21 which engages with the side body structure 1 is fixed to a rear end portion 15B (other end portion).

Figure 2:
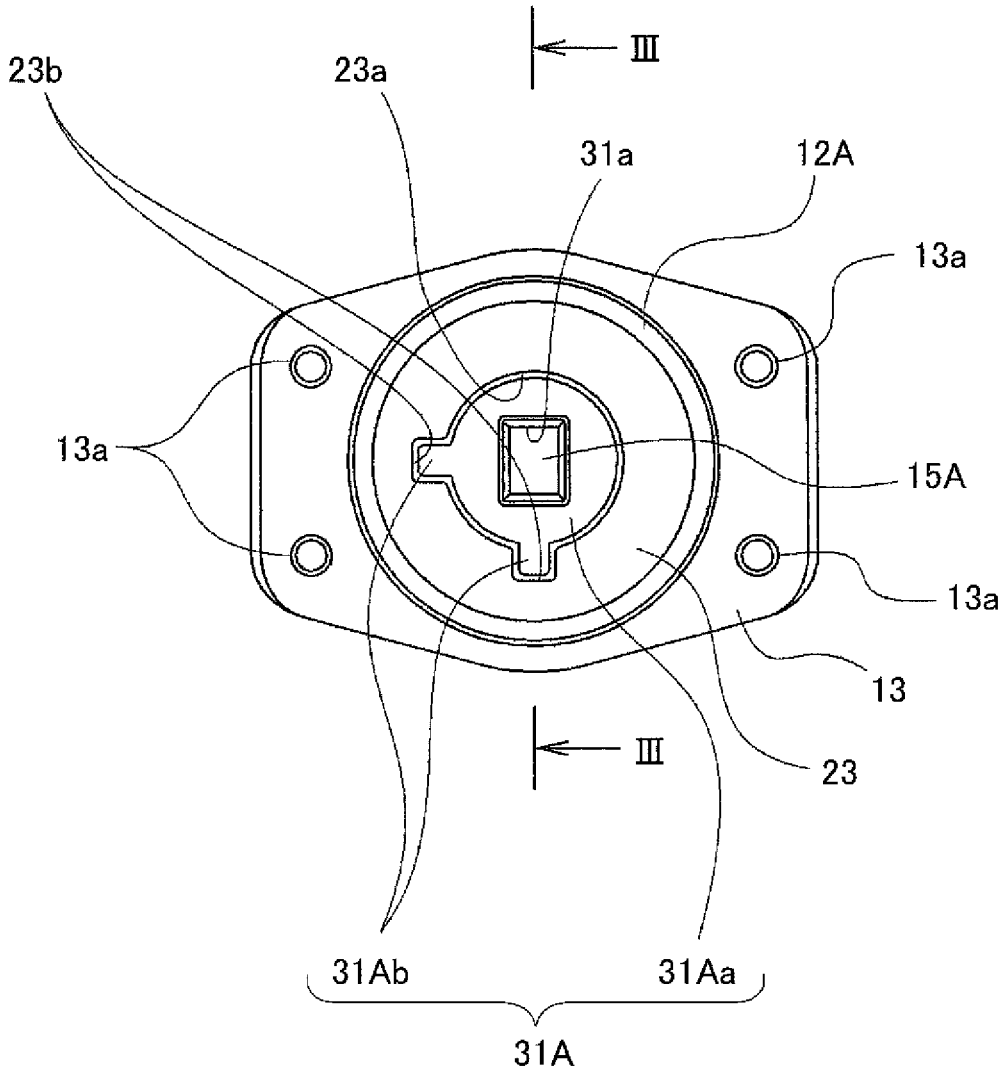
FIG. 2 is a front view of the lid body locking apparatus, and is a view seen from the left to the right in FIG. 1.

In this embodiment, the cross-sectional shape of the operating shaft 15A is a rectangular shape elongated in a vertical direction, as shown in FIG. 2. Here, if the cross-sectional shape of the operating shaft 15A is a circle, it is difficult to give torque to the operating shaft 15A by using a tool. For this reason, the cross-sectional shape of the operating shaft 15A may be any kind of shape as long as it is a non-circular shape. For example, the cross-sectional shape of the operating shaft 15A may be a regular polygonal shape, or may be a diamond shape or an ellipse. Alternatively, it may be a substantially D-shape where a circular shape is partially cut off straight, or it may be a cross shape or the like where a convex portion and a concave portion are repeated on side faces thereof.

The body member 12 includes a bearing part 12B which pivotably supports an intermediate part 15D of the shaft member 15, rearward of the lid body 2, and a cylindrical part 12A which accommodates the operating shaft 15A. An O-ring 16 is disposed at both ends of the bearing part 12B, respectively. In this embodiment, the lid body 2 has a hollow structure which has an internal surface portion and an external surface portion. A mounting hole 2*a* is formed in the internal surface portion, and an exposed hole 2*b* (refer to FIG. 1) having the same size as a mounting hole 2*a* is formed in the external surface portion. The cylindrical part 12A extends forward from the bearing part 12B through the mounting hole 2*a* and the exposed hole 2*b*. Note that a tip end face 12Aa of the cylindrical part 12A is formed in a sloped surface which inclines with respect to the center line of the cylindrical part 12A so that it forms a single surface with the external surface of the lid body 2 and, thus, there is no part which projects from the external surface of the lid body 2.

Between the cylindrical part 12A and the bearing part 12B, a flange part 12C is provided along the back side of the lid body 2. On the other hand, a fitting 13 is arranged on the opposite side of the flange part 12C so that the internal surface portion of the lid body 2 is located therebetween. The fitting 13 has tapped holes 13*a* (refer to FIG. 2), and the body member 12 is fixed to the lid body 2 by threadedly engaging bolts 14 (refer to FIG. 1) with the tapped holes 13*a* from the rear in a state where the internal surface portion of the lid body 2 is pinched between the flange part 12C and the fitting 13.

A flange part 15C is also provided to the shaft member 15, between the operating shaft 15A of the rectangular cross section and the intermediate part 15D of the circular cross section, and, by this flange part 15C, the relation between the shaft member 15 and the bearing part 12B is defined. The latch member 21, which gives a locking function to prohibit opening of the lid body 2 by the engagement with a latch receiving portion 1*a* of the side body structure 1, is fixed to the rear end portion 15B of the shaft member 15, which projects rearward from the bearing part 12B.

Figure 4:
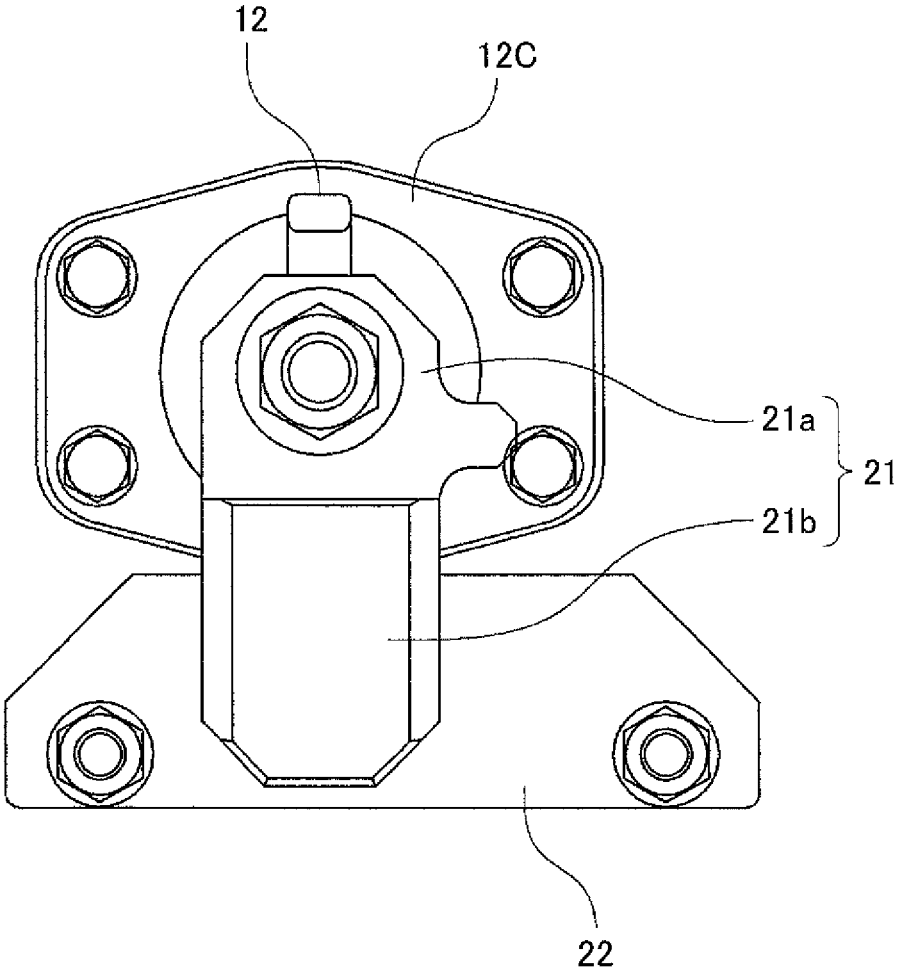
FIG. 4 is a rear view of the lid body locking apparatus, and is a view seen from the right to the left in FIG. 1.

Specifically, the latch member 21 has a mounting part 21*a* which is mounted to the rear end portion 15B of the shaft member 15, and a latch portion 21*b* of a rectangular plate shape formed continuously from the mounting part 21*a*. The lid body 2 is latched (locked) so that the lid body 2 will not be opened, by rotating the shaft member 15 to locate the latch portion 21*b* into a receiver 22 which is provided to the latch receiving portion 1*a* (the side body structure 1) (refer to FIG. 4). The receiver 22 is fixed to the latch receiving portion 1*a*.

A cover member 23 of a ring shape is arranged inside the cylindrical part 12A of the body member 12, at a position corresponding to a tip end of the operating shaft 15A, i.e., at a position apart from the bearing part 12B. The cover member 23 has a larger inner diameter than a length of the diagonal line of the cross-sectional shape of the operating shaft 15A so that a clearance is defined around the operating shaft 15A. The cover member 23 is fixed to an inner circumferential surface 23*a* of the cylindrical part 12A using screws 24 (refer to FIG. 1) from outside the cylindrical part 12A.

Two engagement grooves 23*b* extending in the axial direction of the shaft member 15 are formed in the inner circumferential surface 23*a* of the cover member 23. Each engagement groove 23*b* has a rectangular shape in cross section, and is recessed radially outward from the inner circumferential surface 23*a* of the cover member 23. The two engagement grooves 23*b* are arranged so that the angle of 90 degrees is formed therebetween in the circumferential direction, and have the same shape. Note that the engagement grooves 23*b* may not have the same shape, and the number of the engagement grooves 23*b* is not limited to two and may also be three, for example.

A movable member 31 is arranged inside the cylindrical part 12A of the body member 12, rearward of the cover member 23. The movable member 31 has a base plate part 31B which can contact the back side of the cover member 23, and a projected portion 31A which projects from the base plate part 31B so that the clearance between the operating shaft 15A and the cover member 23 is filled. Further, between the movable member 31 and the bearing part 12B of the body member 12, a coil spring 32 (spring member) with a larger coil diameter than the largest diameter of the shaft member 15 is arranged so as to surround the operating shaft 15A. The coil spring 32 always biases the movable member 31 toward the cover member 23. In other words, the base plate part 31B of the movable member 31 is pressed against the back side of the cover member 23 by the coil spring 32.

A through hole 31*a* having a rectangular cross section is formed at the center of the movable member 31, and the operating shaft 15A is fitted in the through hole 31*a* so that it is slidable but not rotatable. That is, the movable member 31 slides rearwardly on the operating shaft 15A by being pushed against the spring force of the coil spring 32. Further, the movable member 31 rotates together with the shaft member 15 by rotating the operating shaft 15A.

Figure 7:
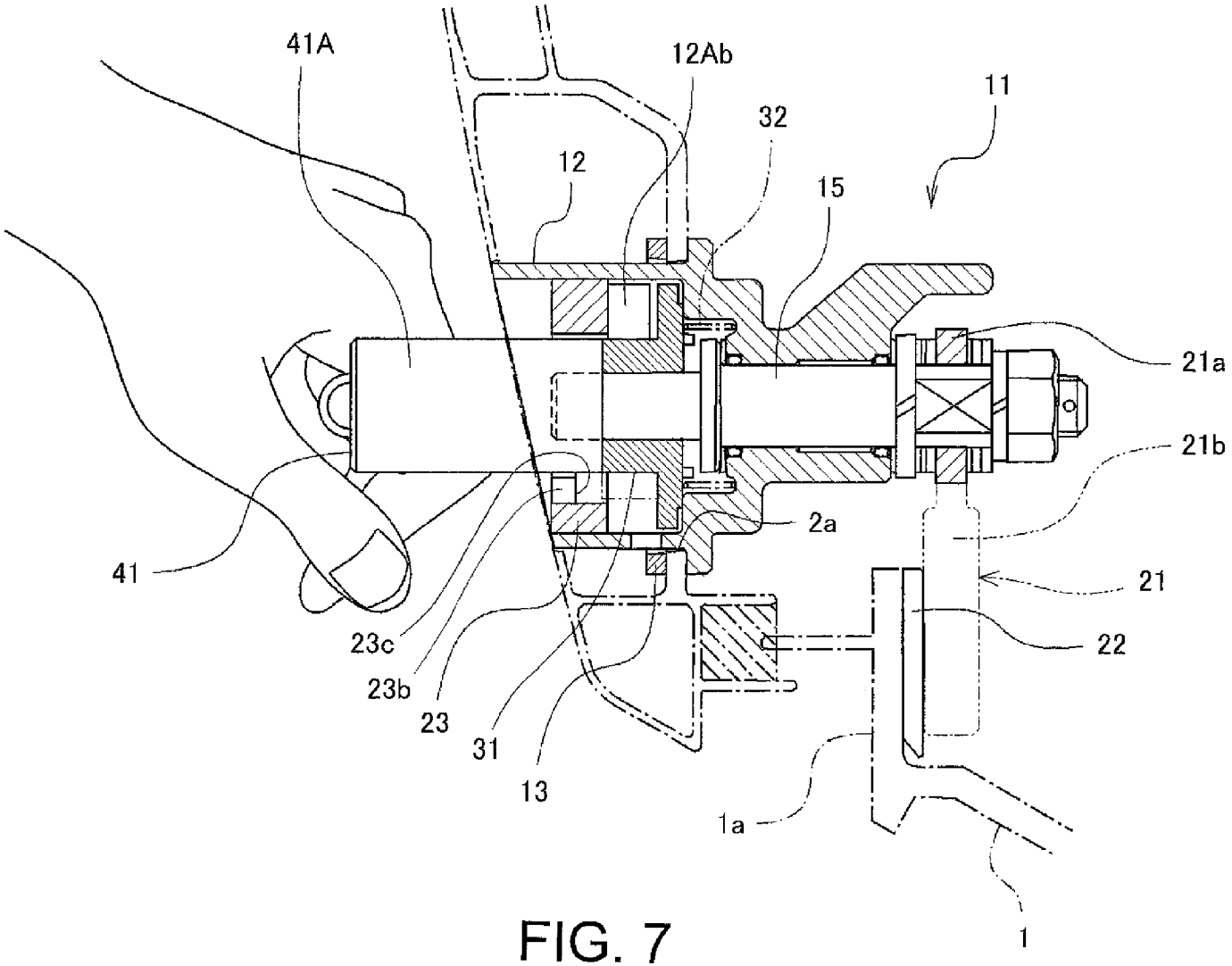
FIG. 7 is a view illustrating a condition of use of the tool.

The movable member 31 is configured so that it locates at a normal position (refer to FIG. 3) where it fills the clearance between the operating shaft 15A and the cover member 23 when the latch member 21 engages with the side body structure 1, and it is maintained at a retreated position (refer to FIG. 7) where it is retreated rearward from the normal position (near the bearing part 12B) when the movable member 31 is plunged and the operating shaft 15A is rotated to release the engagement between the latch member 21 and the side body structure 1.

Figure 5:
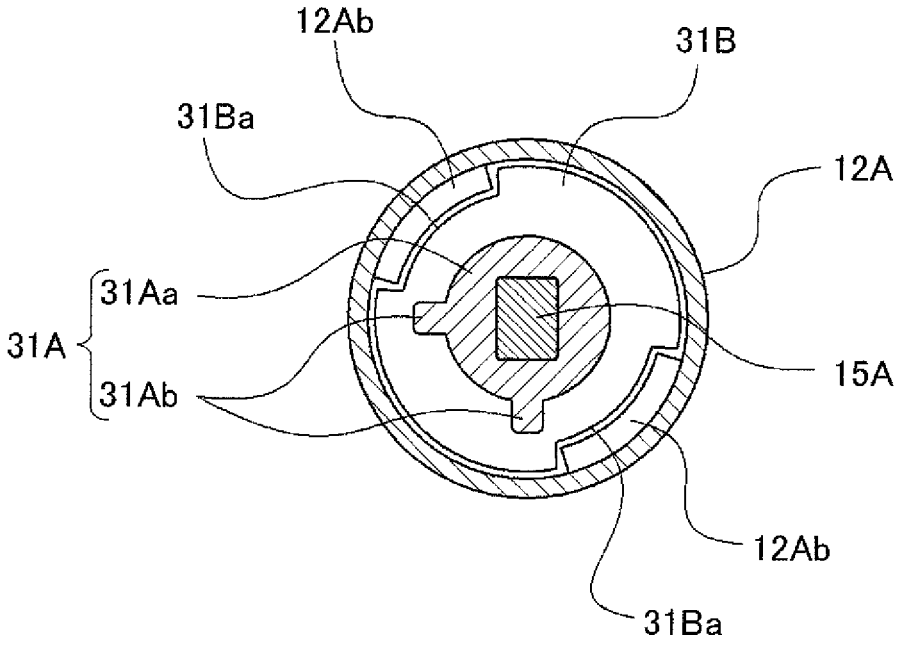
FIG. 5 is a V-V line cross-sectional view of FIG. 3.

In this embodiment, a pair of stopper protruded piece parts 12Ab projecting radially inward as shown in FIG. 5 are provided on the inner circumferential surface of the cylindrical part 12A, at positions close to the cover member 23. On the other hand, a pair of notches 31Ba are formed in the base plate part 31B, corresponding to the stopper protruded piece parts 12Ab, respectively. Then, when the movable member 31 is rotated after pushing into the movable member 31 until the base plate part 31B moves beyond the stopper protruded piece parts 12Ab, the base plate part 31B is latched by the pair of stopper protruded piece parts 12Ab. Thereby, the movable member 31 is maintained at the retreated position.

The projected portion 31A of the movable member 31 projects forward from the base plate part 31B located rearward of the cover member 23, and has substantially the same height as the thickness of the cover member 23. More specifically, the projected portion 31A has a tubular central base portion 31Aa having the outer circumferential surface of substantially the same diameter as the diameter of the inner circumferential surface 23*a* of the cover member 23, and two engaging pawl portions 31Ab which radially project from the central base portion 31Aa. The two engaging pawl portions 31Ab have the shape corresponding to the engagement grooves 23*b* of the cover member 23, and they engage with the engagement grooves 23*b*, respectively, when the movable member 31 is located at the normal position.

Figure 6:
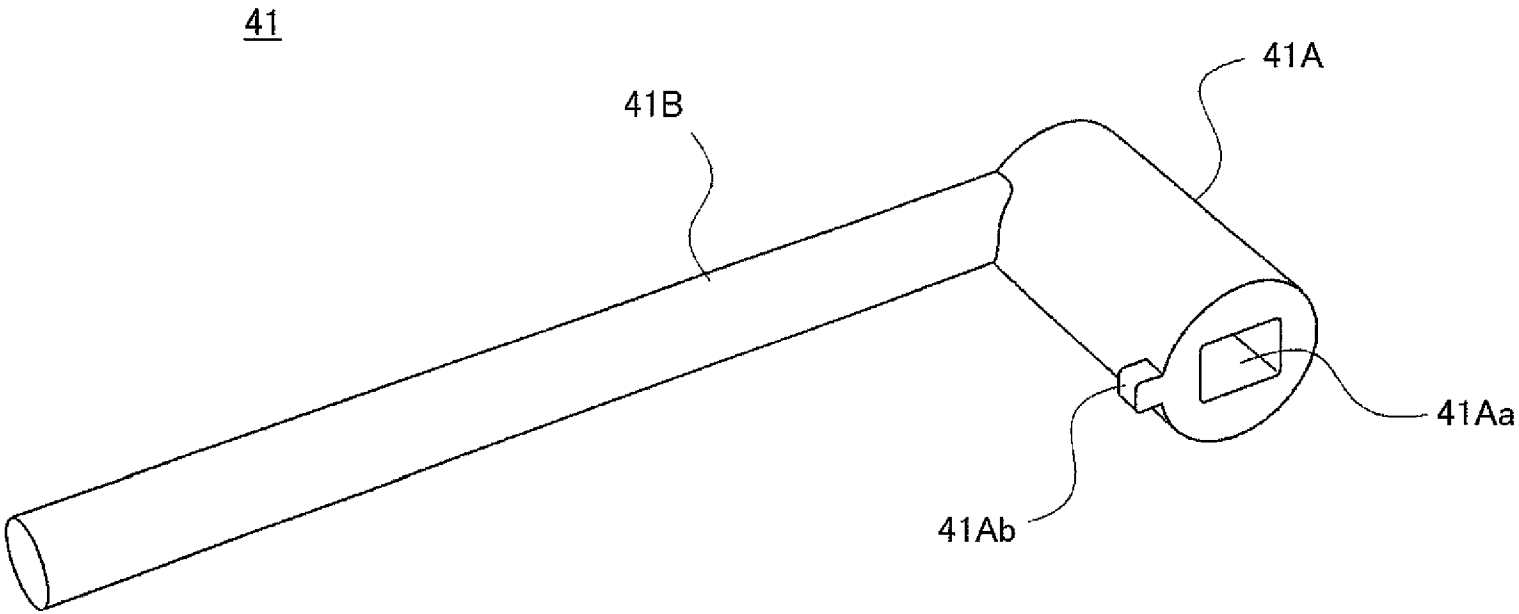
FIG. 6 is a view of a tool.

In the meantime, the shaft member 15 is rotated by the tool 41 shown, for example, in FIG. 6. The tool 41 includes a hollow pushing part 41A for pushing into the movable member 31, having a recessed portion 41Aa of a rectangular shape in cross section which is engageable and disengageable with/from the operating shaft 15A, a pushing pawl portion 41Ab provided to the hollow pushing part 41A, corresponding to the engaging pawl portion 31Ab, and a shaft portion 41B formed continuously to the hollow pushing part 41A.

When unlocking, the pushing pawl portion 41Ab is inserted into one of the two engagement grooves 23*b* (lower side in FIG. 2) and, at the same time, the tool 41 is plunged so that the operating shaft 15A engages with the recessed portion 41Aa (refer to FIG. 7), and, after that, by rotating the tool 41 entirely, the latch member 21 can be rotated together with the shaft member 15 and the movable member 31. Note that a counterbore 23*c* (refer to FIG. 7) is formed on the back side of the cover member 23, throughout the two engagement grooves 23*b*, in order to avoid interference with the pushing pawl portion 41Ab of the tool 41. Since the pushing pawl portion 41Ab is located rearward of the cover member 23 in the middle of rotation of the tool 41, the tool 41 cannot be pulled out at any intermediate rotational position. Then, by rotating the tool 41 about 90 degrees, the engagement between the latch member 21 and the latch receiving portion 1*a* (receiver 22) of the side body structure 1 is released, and the lid body 2 becomes in an unlocked state. Then, the pushing pawl portion 41Ab is pulled out from the other engagement groove 23*b* (left side in FIG. 2). In this state, one of the engaging pawl portions 31Ab is latched by the cover member 23, while the base plate part 31B is latched by the stopper protruded piece part 12Ab. That is, the one engaging pawl portion 31Ab is another configuration which maintains the movable member 31 at the retreated position.

In addition, at this time, since the movable member 31 is located at the retreating position apart rearward from the cover member 23, the operating shaft 15A of the shaft member 15 becomes in a state where it projects from the movable member 31 and, when one sees the locking apparatus 11, he/she can easily and visually check that the locking apparatus 11 is in the unlocked state.

When locking after the completion of checking and the like in the state where the lid body 2 is opened, similar to the case of unlocking, the tool 41 is plunged so that the operating shaft 15A engages with the recessed portion 41Aa while the pushing pawl portion 41Ab is inserted into the other engagement groove 23*b*, and, in this state, when the entire tool 41 is rotated, the latch member 21 and the movable member 31 rotate together with the shaft member 15, and, when the tool 41 is pulled out at the time of the pushing pawl portion 41Ab being in agreement with the one engagement groove 23*b*, the latch member 21 becomes in the engagement state with the latch receiving portion 1*a* (receiver 22) of the side body structure 1 and, thus, the lid body 2 becomes in the locked state. At this time, the end face of the operating shaft 15A, the outer surface of the cover member 23, and the tip end face of the projected portion 31A of the movable member 31 form a single surface, and one can easily and visually check that it is in the locked state instead of the unlocked state.

Thus, by using the tool 41, the operator can easily unlock and lock the lid body 2, and, in the locked state, the end face of the operating shaft 15A, the outer surface of the cover member 23, and the tip end face of the projected portion 31A of the movable member 31 form a single surface. Therefore, one cannot unlock it using a wrench, a hexagonal wrench or the like, and he/she is necessary to use the special tool 41. Therefore, unlocking is difficult for persons other than the operator. In addition, since a flat surface is formed within the cylindrical part 12A by the operating shaft 15A, the cover member 23, and the movable member 31 when the movable member 31 is located at the normal position, air resistance of the railcar at the time of traveling can be suppressed.

In addition, since the coil spring 32 is arranged so as to surround the operating shaft 15A and the coil diameter is increased to increase the spring force, the locked state can be maintained by the large spring force. For this reason, unless the tool 41 is used, it cannot be unlocked carelessly by any third parties other than the operator.

Since the latch portion 21*b* of the latch member 21 is formed in the symmetrical rectangular plate shape, the latch portion 21*b* can be located inside the latch receiving portion 1*a* (the receiver 22), regardless of the rotation of the shaft member 15 in either direction. Thus, if it can be applied to a case where the clockwise rotation is used for locking and the counterclockwise rotation is used for unlocking, and it can also be applied to the case where the counterclockwise rotation is used for locking and the clockwise rotation is used for unlocking. Therefore, even if the locking apparatuses 11 are provided on both the left and right sides (in the vehicle longitudinal direction) of the lid body 2, and one of the locking apparatuses 11 is configured to be rotated clockwise for locking and counterclockwise for unlocking and the other locking apparatus 11 is configured to be rotated counterclockwise for locking and clockwise for unlocking, it is not necessary to change the shape of the latch members 21 and the latch member 21 can be commonly used.

Since the cover member 23 and the movable member 31 are arranged inside the cylindrical part 12A of the body member 12, the apparatus can be reduced in size and tool applying parts, such as the cover member 23 and the movable member 31, can be protected by the cylindrical part 12A.

The present invention can be implemented after the following changes are made, other than implemented in the above embodiment.

Figure 8:
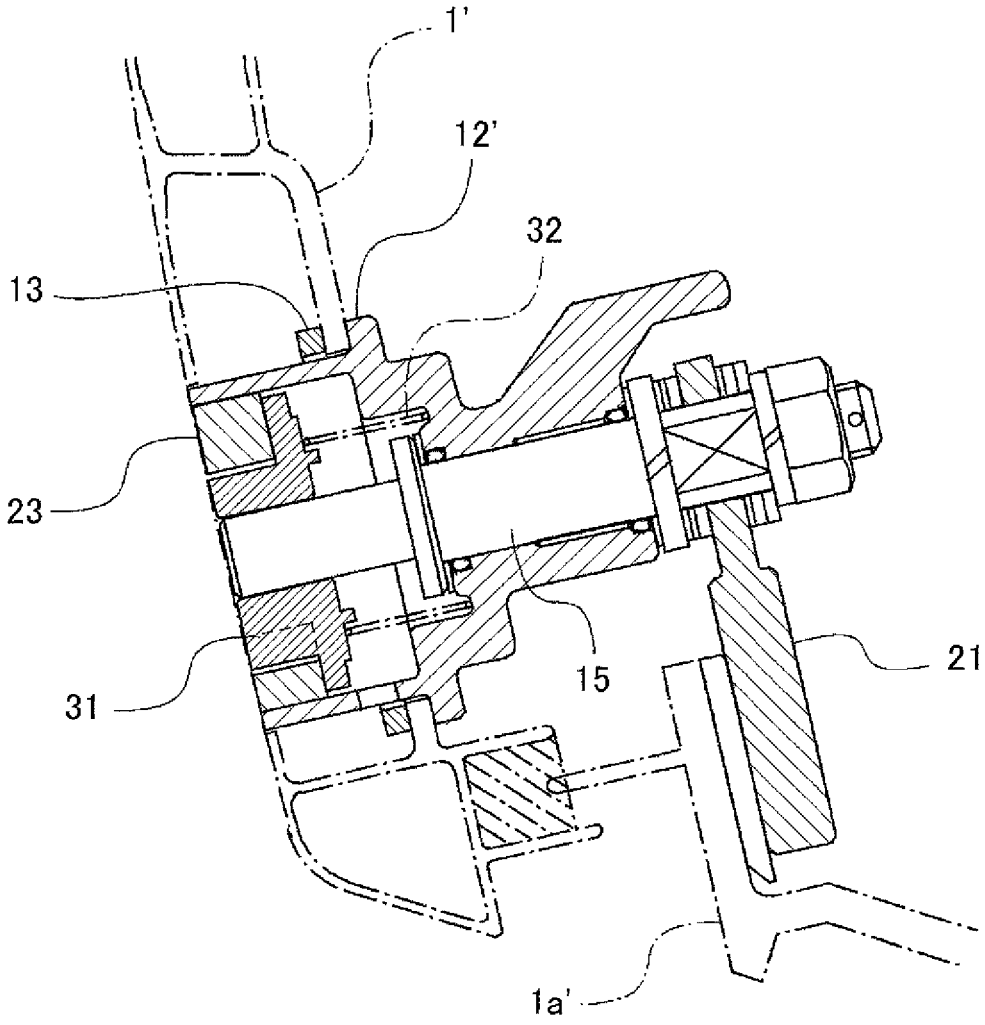
FIG. 8 is a view of another embodiment, which is similar to FIG. 3.

By changing the shape of the body member to devise the shape of the body member 12' and the axial direction of the shaft member 15 as shown in FIG. 8, it is also possible to form a single surface by the external surface of the side body structure 1' (where the latch receiving portion is 1*a*'), and the tip end face 12Aa of the cylindrical part 12A, the outer surfaces of the cover member 23 and the movable member 31, and the end face of the operating shaft 15A. As described above, since the tip end face 12Aa of the cylindrical part 12A forms a single smooth surface with the outer surfaces of the cover member 23 and the movable member 31, this can be preventive measures for snow accretion and noise and, thus, it is suitable when being used for rapid transit railway vehicles which travels in a heavy snowfall area at high speed.

(ii) Although, in the embodiment, it is a lower-side opening type where the hinges are provided to the upper edge of the lid body 2, it is needless to say that the present invention is also applicable to an upper-side opening type where the hinges are provided to the lower edge of the lid body, as well as to a horizontally opening type where the hinges are provided to either one of the left edge or the right edge of the lid body.

(iii) When locking the lid body by the plurality of lid body locking apparatuses, one of the plurality of lid body locking apparatuses is used as the lid body locking apparatus according to the present invention, and, of course, it is also possible to use fastening bolts or the like as the other lid body locking apparatus.

(iv) It is not necessary to provide two sets of engagement grooves 23*b* and engaging pawl portions 31Ab. For example, when the engagement state of the latch member 21 and the side body structure 1 is released where two engagement grooves 23*b* and one engaging pawl portion 31Ab are used, the base plate part 31B of the movable member 31 may be maintained at the retreated position only by being latched by the stopper protruded piece part 12Ab.

(v) Alternatively, two sets of engagement grooves 23*b* and engaging pawl portions 31Ab are provided, and when the engagement of the latch member 21 and the side body structure 1 is released and the movable member 31 is maintained at the retreated position, and when a configuration in which one of the engaging pawl portions 31Ab is latched by the cover member 23, it is also possible to omit the stopper protruded piece part 12Ab.

(vi) Further, when using the tool 41 without the pushing pawl portion 41Ab, and a single engagement groove 23*b* and a single engaging pawl portion 31Ab may be provided and the engaging pawl portion 31Ab may be latched by the back side of the cover member 23 to maintain the movable member 31 at the retreated position. Alternatively, when using the tool 41 without the pushing pawl portion 41Ab, the engagement groove 23*b* and the engaging pawl portion 31Ab may be omitted, and the movable member 31 may be maintained at the retreating position by the movable member 31 being latched by the stopper protruded piece part 12Ab. In this case, a counter mark may be stamped on the end face of the operating shaft 15A and the outer surface of the cover member 23 so that it indicates a position at which the end face of the operating shaft 15A and the outer surface of the cover member 23 are located to be in the locked state.

Figure 9:
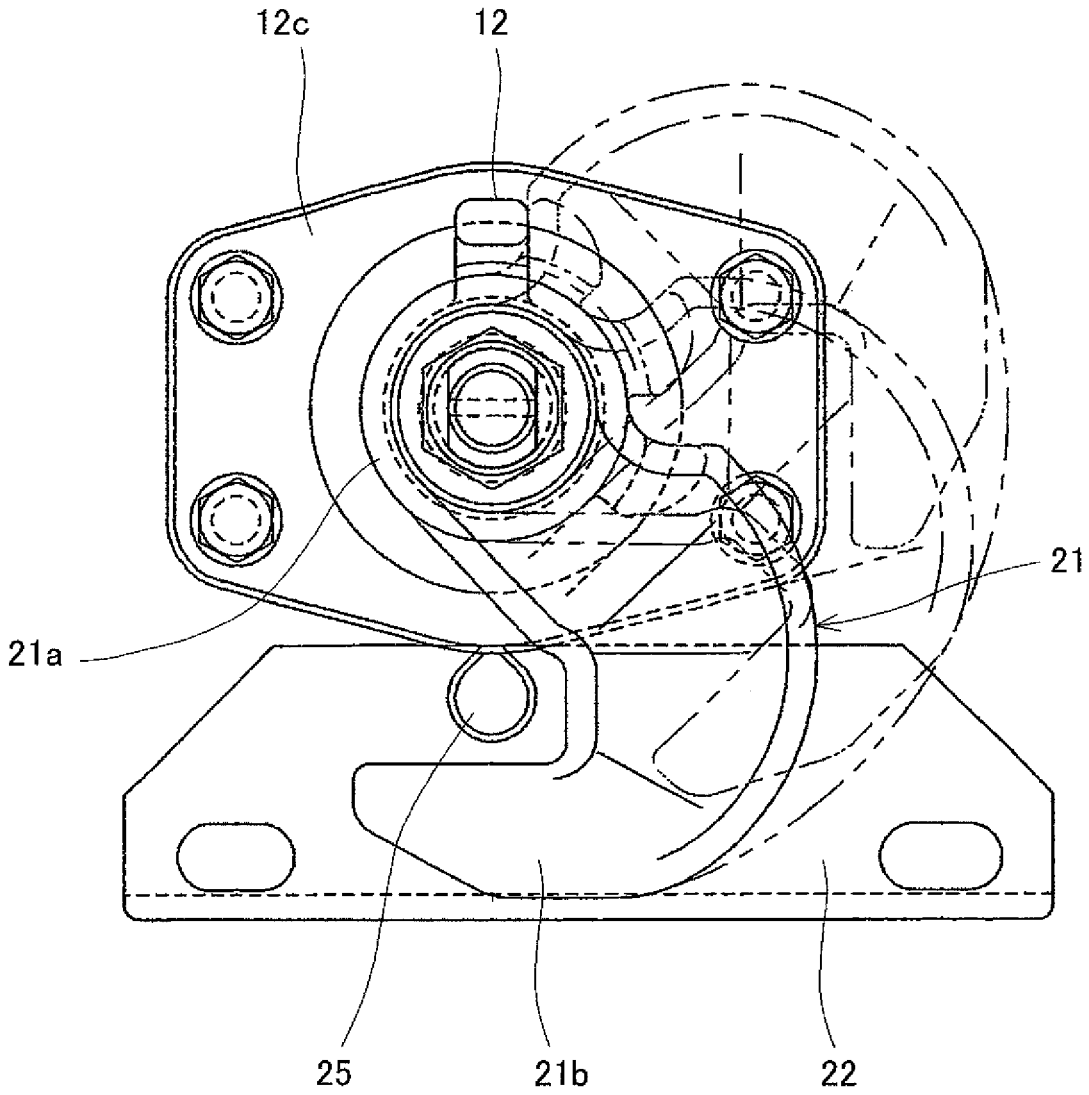
FIG. 9 is a view of still another embodiment, which is similar to FIG. 4.

(vii) The latch portion 21*b* of the latch member 21 is not necessary to be the horizontally symmetrical rectangular plate shape. For example, as shown in FIG. 9, the latch portion 21*b* may have a hook-like shape. By this configuration, it is prevented that the latch member 21 is unlocked due to a frictional force produced between the latch portion 21*b* and the receiver 22, and, even if the lid body 2 is deformed, the locked state of the lid body 2 can be maintained by the pin 25.

DESCRIPTION OF REFERENCE NUMERALS

1 Side Body Structure
1*a* Latch Receiving Portion
2 Lid Body
2*a* Mounting Hole
2*b* Exposed Hole
11 Lid Body Locking Apparatus
12, 12' Body Member
12A Cylindrical Part
12Aa Tip End Face
12Ab Stopper Protruded Piece Part
12B Bearing Part
12C Flange Part
13 Fitting
15 Shaft Member
15A Operating Shaft (One End Portion)
15B Other End Portion
15C Flange Part
15D Intermediate Part
21 Latch Member
21*a* Mounting Part
21*b* Latch Portion
22 Receiver
23 Cover Member
23*a* Inner Circumferential Surface
23*b* Engagement Groove
23*c* Counterbore
24 Screw
25 Pin
31 Movable Member
31*a* Through Hole
31A Projected Portion
31Aa Central Base Portion
31Ab Engaging Pawl Portion
31B Base Plate Part
31Ba Notch
32 Coil Spring
41 Tool
41A Hollow Pushing Part
41Aa Recessed Portion
41Ab Pushing Pawl Portion

The invention claimed is:

1. A lid body locking apparatus of a railcar, for locking a lid body to a car body of the railcar in a state where the lid body closes an opening formed in the car body, the lid body being configured to open and close the opening, the apparatus comprising:

a shaft member having one end portion formed with an operating shaft of a non-circular shape in cross section and another end portion fixed to a latch member that engages with the car body to lock the lid body to the car body;

a body member penetrating the lid body, and including a bearing part for rotatably supporting an intermediate part of the shaft member and a cylindrical part for accommodating the operating shaft;

a cover member of a ring shape, fixed to an inner circumferential surface of the cylindrical part at a position corresponding to a tip end of the operating shaft, and defining a clearance around the operating shaft; and a movable member slidably fitted onto the operating shaft, wherein:

the movable member is configured to be located at a normal position where it fills the clearance between the operating shaft and the cover member when the latch member engages with the car body, and the movable member is configured to be maintained at a retreated position that is retreated from the normal position when the engagement between the latch member and the car body is released by:

firstly, pushing the movable member together with a tool such that the tool and the movable member are moved together along the operating shaft, secondly, rotating the operating shaft and the movable member with the tool, and thirdly, separating the tool from the movable member, causing the movable member to be maintained in the retreated position.

2. The lid body locking apparatus of the railcar of claim 1, wherein the movable member includes a base plate part that is able to contact a back side of the cover member, and a projected portion projecting from the base plate part to fill the clearance between the operating shaft and the cover member, and wherein the apparatus further comprises a spring member for biasing the movable member toward the cover member.

3. The lid body locking apparatus of the railcar of claim 2, wherein at least one engagement groove extends in an axial direction of the shaft member and is formed in an inner circumferential surface of the cover member, and wherein the projected portion of the movable member includes a central base portion of a tubular shape, and at least one engaging pawl portion that radially projects from the central base portion and engages with the at least one engagement groove when the movable member is located at the normal position.

4. The lid body locking apparatus of the railcar of claim 2, wherein the spring member is a coil spring arranged to surround the operating shaft.

5. The lid body locking apparatus of the railcar of claim 1, wherein the latch member includes a mounting part mounted to the other end portion of the shaft member, and a latch portion of a rectangular plate shape formed continuously to the mounting part, and the latch member engages with the car body by locating the latch portion inside a latch receiving portion of the car body.

6. The lid body locking apparatus of the railcar of claim 1, wherein an external surface of the lid body, surfaces of the body member and the cover member form a single surface.

7. A lid body locking apparatus of a railcar, for locking a lid body to a car body of the railcar in a state where the lid body closes an opening formed in the car body, the lid body being configured to open and close the opening, the apparatus comprising:

a shaft member having one end portion formed with an operating shaft of a non-circular shape in cross section and another end portion fixed to a latch member that engages with the car body to lock the lid body to the car body;

a body member penetrating the lid body, and including a bearing part for rotatably supporting an intermediate part of the shaft member and a cylindrical part for accommodating the operating shaft;

a cover member of a ring shape, fixed to an inner circumferential surface of the cylindrical part at a position corresponding to a tip end of the operating shaft, and defining a clearance around the operating shaft; and a movable member slidably fitted onto the operating shaft, wherein:

the movable member is configured to be located at a normal position where it fills the clearance between the operating shaft and the cover member when the latch member engages with the car body, the movable member is configured to be maintained at a retreated position that is retreated from the normal position when the engagement between the latch member and the car body is released by pushing into the movable member and rotating the operating shaft, the movable member includes a base plate part that is able to contact a back side of the cover member, and a projected portion projecting from the base plate part to fill the clearance between the operating shaft and the cover member, the apparatus further comprises a spring member for biasing the movable member toward the cover member, at least one engagement groove extends in an axial direction of the shaft member and is formed in an inner circumferential surface of the cover member, the projected portion of the movable member includes a central base portion of a tubular shape, and at least one engaging pawl portion that radially projects from the central base portion and engages with the at least one engagement groove when the movable member is located at the normal position, the operating shaft is rotated by a tool, the tool includes a hollow pushing part having a recessed portion that is engageable and disengageable with/from the operating shaft and for pushing into the movable member, and a pushing pawl portion provided to the hollow pushing part and corresponding to the at least one engaging pawl portion, the at least one engagement groove includes two engagement grooves, and the cover member is configured so that the tool is plunged to engage the operating shaft with the recessed portion while inserting the pushing pawl portion into one of the engagement grooves, the entire tool is rotated to release the engagement between the latch member and the car body, and the pushing pawl portion can then be pulled out from the other one of the engagement grooves.

8. The lid body locking apparatus of the railcar of claim 3, wherein the spring member is a coil spring arranged to surround the operating shaft.

9. The lid body locking apparatus of the railcar of claim 2, wherein the latch member includes a mounting part mounted to the other end portion of the shaft member, and a latch portion of a rectangular plate shape formed continuously to the mounting part, and the latch member engages with the car body by locating the latch portion inside a latch receiving portion of the car body.

10. The lid body locking apparatus of the railcar of claim 3, wherein the latch member includes a mounting part mounted to the other end portion of the shaft member, and a latch portion of a rectangular plate shape formed continuously to the mounting part, and the latch member engages with the car body by locating the latch portion inside a latch receiving portion of the car body.

11. The lid body locking apparatus of the railcar of claim 4, wherein the latch member includes a mounting part mounted to the other end portion of the shaft member, and a latch portion of a rectangular plate shape formed continuously to the mounting part, and the latch member engages with the car body by locating the latch portion inside a latch receiving portion of the car body.

12. The lid body locking apparatus of the railcar of claim 2, wherein an external surface of the lid body, surfaces of the body member and the cover member form a single surface.

13. The lid body locking apparatus of the railcar of claim 3, wherein an external surface of the lid body, surfaces of the body member and the cover member form a single surface.

14. The lid body locking apparatus of the railcar of claim 4, wherein an external surface of the lid body, surfaces of the body member and the cover member form a single surface.

15. The lid body locking apparatus of the railcar of claim 5, wherein an external surface of the lid body, surfaces of the body member and the cover member form a single surface.

16. The lid body locking apparatus of the railcar of claim 3, wherein the at least one engaging pawl portion contacts at least one stopper protruded piece part of the body member so as to maintain the movable member in the retreated position.

* * * * *